US011840749B2

(12) United States Patent
Ishizuka

(10) Patent No.: US 11,840,749 B2
(45) Date of Patent: Dec. 12, 2023

(54) MAGNESIUM-LITHIUM-BASED ALLOY

(71) Applicant: CANON KABUSHIKI KAISHA, Tokyo (JP)

(72) Inventor: Keiichi Ishizuka, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/070,724

(22) Filed: Oct. 14, 2020

(65) Prior Publication Data

US 2021/0025037 A1 Jan. 28, 2021

Related U.S. Application Data

(63) Continuation of application No. PCT/JP2019/016095, filed on Apr. 15, 2019.

(30) Foreign Application Priority Data

Apr. 23, 2018 (JP) ..... 2018-082571
Mar. 6, 2019 (JP) ..... 2019-040903

(51) Int. Cl.
*C22C 23/00* (2006.01)
*C22C 24/00* (2006.01)

(52) U.S. Cl.
CPC ..... *C22C 24/00* (2013.01)

(58) Field of Classification Search
CPC ..... C22C 23/00; C22C 24/00; C22F 1/06
See application file for complete search history.

(56) References Cited

U.S. PATENT DOCUMENTS 4,233,376 A 11/1980 Atkinson
2012/0222784 A1* 9/2012 Kin ..... C23C 23/34 148/420

FOREIGN PATENT DOCUMENTS

| | | | |
|---|---|---|---|
| CN | 1876872 | A | 12/2006 |
| CN | 10158860 | A | 10/2007 |
| CN | 101121981 | A | 2/2008 |
| CN | 102741436 | A | 10/2012 |
| CN | 102753714 | A | 10/2012 |
| CN | 103031474 | A | 4/2013 |
| CN | 107475587 | A | 12/2017 |
| CN | 107 587 016 | A | 1/2018 |
| CN | 107 868 897 | A | 4/2018 |
| CN | 107 904 463 | A | 4/2018 |
| JP | 08134581 | A | 5/1996 |
| JP | 2008069418 | A | 3/2008 |
| JP | 11084818 | A | 4/2011 |
| JP | 2016180134 | A | 10/2016 |
| TW | 200840874 | A | 10/2008 |
| WO | 2008016150 | A1 | 2/2008 |

OTHER PUBLICATIONS

English Abstractor CN 108048719 (Year: 2017).*

(Continued)

*Primary Examiner* — Jessee R Roe
(74) *Attorney, Agent, or Firm* — Canon U.S.A., Inc., IP Division

(57) ABSTRACT

A magnesium-lithium-based alloy contains Mg, Li, and Al, and a sum of a content of the Mg and a content of the Li is 90% by mass or more. The magnesium-lithium-based alloy contains Ge.

13 Claims, 6 Drawing Sheets

(56) References Cited

OTHER PUBLICATIONS

Wang, Tao, et al. "Effects of calcium on the microstructures and tensile properties of Mg—5Li—3Al alloys." Materials Science and Engineering: A 528.18 (2011): 5678-5684.*
English Abstract and English Machine Translation of Yang (CN 108048719) (May 18, 2018).*
Moskalyk, Ray R. "Review of germanium processing worldwide." Minerals engineering 17.3 (2004): 393-402.*
Polmear, I.J., "Grade and Alloys", pp. 12-25, 1999.
Editorial Committee of Light Metal Material Processing Manual, Light Metal Material Processing Manual vol. 1, Dec. 31, 1979.
Yuanyuan, L., New Materials and Science and Technology Metal Materials, Sep. 30, 2012.
Zhong, L. Y., et al., "General Teaching Materials for Higher Vocational Colleges in the 21st Century—Inorganic Chemistry", Sep. 30, 2001.
An, L.J., et al., "Concise Guide to Magnesium Alloy Materials", Aug. 31, 2019.
Zelikman, A.H., et al., "Rare Metal Metallurgy", Oct. 31, 1956 vol. 2.

* cited by examiner

MAGNESIUM-LITHIUM-BASED ALLOY

CROSS-REFERENCE TO RELATED APPLICATIONS

This application is a Continuation of International Patent Application No. PCT/JP2019/016095, filed Apr. 15, 2019, which claims the benefit of Japanese Patent Application No. 2018-082571, filed Apr. 23, 2018 and Japanese Patent Application No. 2019-040903, filed Mar. 6, 2019, all of which are hereby incorporated by reference herein in their entirety.

TECHNICAL FIELD

The present invention relates to a magnesium-lithium-based alloy.

BACKGROUND ART

To realize a reduction in weight of articles, magnesium alloys are used as metal materials. In recent years, a further reduction in weight of articles has been required, and a magnesium-lithium-based alloy described in, for example, Patent Literature 1 has been proposed. However, lithium is a very active (likely to ionize and likely to melt) metal element and thus has, for example, a property of being easily corroded in wet conditions. Therefore, in magnesium-lithium-based alloys, the importance of corrosion resistance is higher than that in magnesium alloys. Patent Literature 1 discloses that the strength is improved by adding aluminum.

CITATION LIST

Patent Literature

PTL 1 Japanese Patent Laid-Open No. 2011-84818

However, even in the case where articles are formed by using existing magnesium-lithium-based alloys, the problem of corrosion of the alloys may occur when the articles are exposed to a high-temperature high-humidity environment for a long time. Accordingly, alloys having better corrosion resistance than such existing alloys have been desired.

In view of the above, an object of the present invention is to provide a magnesium-lithium-based alloy that exhibits good corrosion resistance even when exposed to a high-temperature high-humidity environment for a long time.

SUMMARY OF INVENTION

The inventor of the present invention examined the cause of corrosion of magnesium-lithium-based alloys produced by existing methods and considered that the cause is formation of a precipitated phase in which aluminum or calcium is chemically combined with magnesium, the precipitated phase being formed in a matrix composed of magnesium-lithium. In addition, the inventor of the present invention considered that the cause is segregation of a lithium-rich grain boundary (lithium-rich phase) in the matrix. Furthermore, the inventor of the present invention considered that when water adheres to a surface of an alloy, local electric corrosion occurs between the precipitated phase or lithium-rich phase and the matrix, and lithium is eluted, resulting in corrosion of the alloy. In view of the above, the inventor of the present invention has found that addition of germanium or beryllium to the alloy enables the precipitation and segregation to be suppressed.

Specifically, a magnesium-lithium-based alloy according to the present invention is a magnesium-lithium-based alloy containing Mg, Li, and Al, in which a sum of a content of the Mg and a content of the Li is 90% by mass or more, and the magnesium-lithium-based alloy contains at least one selected from Be and Ge.

Further features of the present invention will become apparent from the following description of exemplary embodiments with reference to the attached drawings.

DESCRIPTION OF EMBODIMENTS

Figure 1:
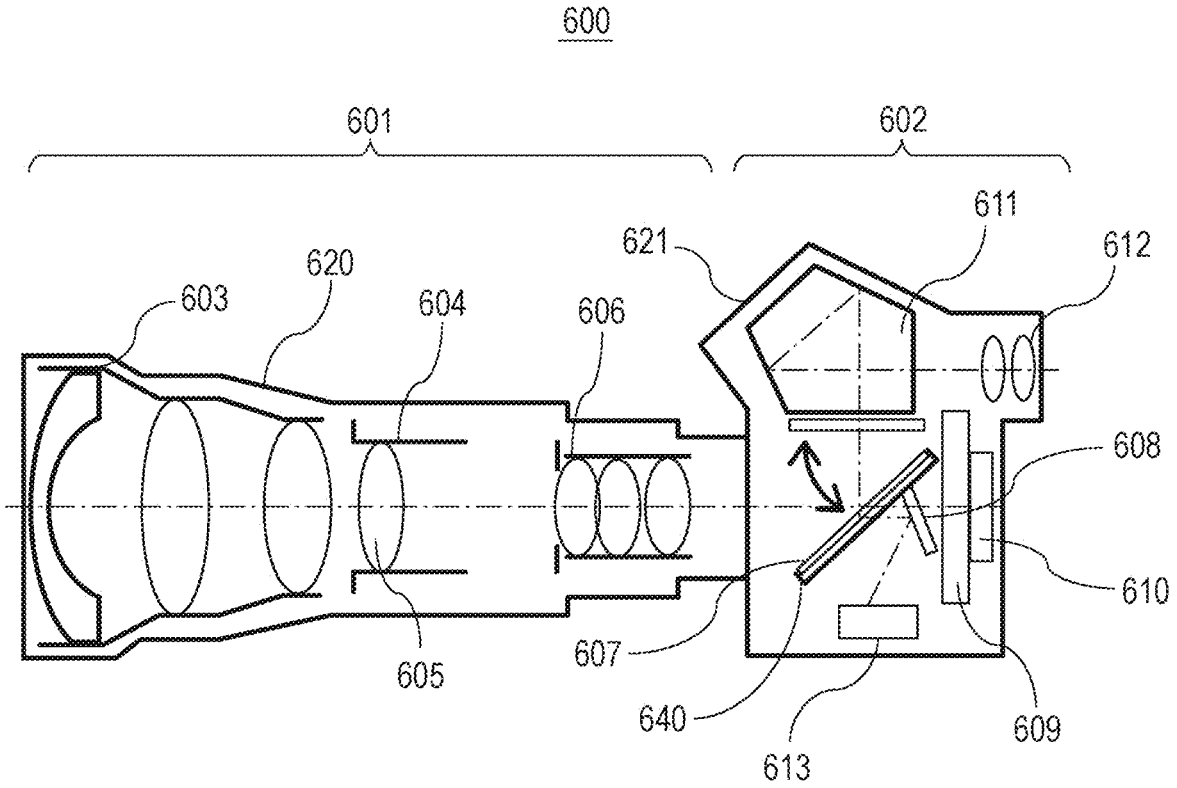
FIG. 1 is a schematic view illustrating an imaging apparatus according to an embodiment.

Hereafter, embodiments for carrying out the present invention will be described in detail with reference to the drawings. FIG. 1 illustrates the configuration of a single-lens reflex digital camera 600, which is an example of a preferred embodiment of an imaging apparatus according to the present invention. Although, in FIG. 1, a camera body 602 and a lens barrel 601, which is an optical apparatus, are combined together, the lens barrel 601 is a so-called interchangeable lens that is detachably attached to the camera body 602.

Light from a subject passes through an optical system 630 including, for example, a plurality of lenses 603 and 605 disposed on the optical axis of an image-capturing optical system in a housing 620 of the lens barrel 601 and is received by an imaging device 610. Thus, an image is captured. Here, the lens 605 is supported by an inner barrel 604 and movably supported for focusing and zooming with respect to an outer barrel of the lens barrel 601.

During an observation period before image-capturing, light from the subject is reflected at a main mirror 607 in a housing 621 of the camera body 602 and transmitted through a prism 611, and a capturing image is then displayed to the photographer through a finder lens 612. The main mirror 607 is, for example, a half mirror, and the light transmitted through the main mirror is reflected from a sub-mirror 608 toward an AF (autofocus) unit 613. The reflected light is used for, for example, distance measurement. The main mirror 607 is mounted and supported on a main mirror holder 640 by bonding or the like. During image-capturing, the main mirror 607 and the sub-mirror 608 are moved out of an optical path by using a driving mechanism (not illustrated), a shutter 609 is opened, and the captured light image incident from the lens barrel 601 is focused on the imaging device 610. A diaphragm 606 is configured to change the brightness and the depth of focus during image-capturing by changing the aperture area. The single-lens reflex digital camera 600 has been described as an example of the imaging apparatus according to the present invention. However, the present invention is not limited thereto. The imaging apparatus may be a smartphone or a compact digital camera.

Figure 2:
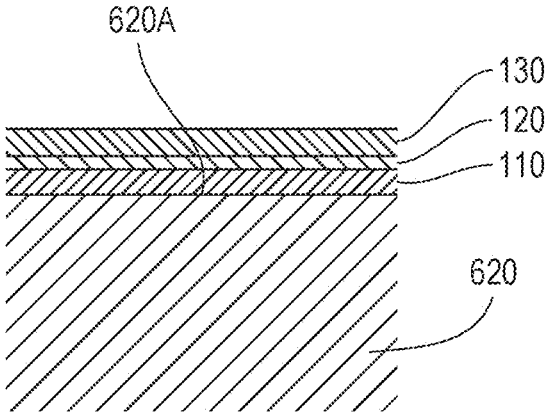
FIG. 2 is a partial sectional view of a housing of a lens barrel according to an embodiment and films formed on a surface of the housing.

FIG. 2 is a partial sectional view of the housing 620 of the lens barrel 601 according to an embodiment and films formed on a surface of the housing 620. As illustrated in FIG. 2, a chemical conversion film 110, a primer 120, and a coating film 130 are formed on a surface 620A of the housing 620. The chemical conversion film 110 is a coating that improves corrosion resistance of the housing 620 and is preferably a phosphate-based coating such as a magnesium phosphate coating. The coating film 130 is a coating film formed from a heat-shielding coating material containing a heat-shielding material. The housing 620 is a member (molded article) formed of a magnesium-lithium-based alloy (Mg—Li-based alloy). The Mg—Li-based alloy that forms the housing 620 of this embodiment contains Mg (magnesium) as a main component.

Mg—Li-based alloys are lightweight metal materials, enable the weight of the housing 620 to be reduced, and enable rigidity and absorption properties of vibrations (vibration-damping properties) to be enhanced. However, since Li (lithium) is a base metal and is easily corroded, it is necessary to improve corrosion resistance of the Mg—Li-based alloys. Therefore, in this embodiment, the surface of the housing 620 is coated with the chemical conversion film 110 that improves corrosion resistance, the chemical conversion film 110 serving as a base of the coating film 130.

Meanwhile, a Mg—Li-based alloy containing Al (aluminum) is known to date. A sample was produced by producing a member formed of this Mg—Li-based alloy, coating the surface of the member with a chemical conversion film, and then coating the chemical conversion film with a coating film. This sample was subjected to a durability test in a high-temperature high-humidity environment for a long time, specifically, in an environment at a temperature of 70° C. and a humidity of 80% RH for 1,000 hours. According to the results, the coating film came off, and corrosion proceeded on the surface of the member.

In this Mg—Li-based alloy, Al is added for the purpose of improving the strength, and a precipitated phase in which Al and Mg are chemically combined is considered to be formed. In addition, it is considered that a lithium-rich grain boundary (lithium-rich phase) is segregated in the matrix. Furthermore, presumably, when water adheres to a surface of the alloy, local electric corrosion occurs between the precipitated phase or lithium-rich phase and the matrix, lithium is eluted to the surface and reacts with the water on the surface, and hydrogen gas is generated, resulting in swelling and coming-off of the coating film.

The inventor of the present invention has found that, in in order to obtain a homogeneous composition of a Mg—Li-based alloy in which segregation and the growth of precipitation are suppressed, the movement of atoms should be inhibited when the alloy is mixed, melted, and solidified. Specifically, the inventor considered that when the atomic radii of main elements of the alloy differ by 1.2 times or more, segregation and precipitation can be suppressed within the solidification time. In addition, when the mixing enthalpy between the main elements is negative, the state of mixing and dispersion of the atoms becomes stable in terms of energy. Accordingly, the inventor considered that selecting such a combination of elements also enables segregation and precipitation to be suppressed.

In a Mg—Li-based alloy containing Al, as described above, the atomic radius (160 pm) of Mg element which is a main component is 1.1 times the atomic radius (143 pm) of Al which is a main element, and thus the difference is small. Accordingly, it was found that Al element is partially replaced by group 2 and groups 11 to 15 elements in the periodic table, the elements satisfying the condition described above and having smaller atomic radii than Al element.

The metal element that partially replaces Al element is preferably one or both of Ge (germanium) element and Be (beryllium) element. That is, when a Mg—Li-based alloy contains Al and at least one of Ge and Be, segregation and precipitation, which become a starting point of corrosion, are prevented, and the alloy tends to have a homogeneous composition. Specifically, the alloy easily becomes amorphous, or crystal grains included in the alloy easily become finer. Since precipitation and segregation are prevented by the crystal refinement of the alloy or amorphization of the alloy, the alloy has improved corrosion resistance. Here, Ge and Be each have an atomic radius of 122 pm. The content of Ge in the alloy is preferably 0.1% by mass or more and less than 1% by mass, and more preferably 0.1% by mass or more and 0.8% by mass or less from the viewpoint of increasing the strength of the alloy. The content of Be in the alloy is preferably 0.04% by mass or more and less than 3% by mass, and more preferably 0.04% by mass or more and 0.11% by mass or less from the viewpoint of increasing the strength of the alloy. The content of Be and Ge is lower than the content of Al.

The metal element that partially replaces Al element preferably further includes at least one metal element selected from Si (silicon), P (phosphorus), Zn (zinc), and As (arsenic) besides Ge and Be. Here, Si, P, Zn, and As have atomic radii of 117 pm, 110 pm, 137 pm, and 121 pm, respectively. Since these metal elements also have smaller atomic radii than Al element, and the precipitation and segregation are further prevented, the alloy has improved corrosion resistance. Copper (Cu) has an atomic radius of 128 pm, which is smaller than the atomic radius of Al. However, if the Mg—Li-based alloy contains Cu, the alloy may be easily oxidized. Therefore, addition of Cu is not preferred. The content of Si, P, Zn, and As is lower than the content of Al.

In the Mg—Li-based alloy of this embodiment, the sum of the content of Mg and the content of Li needs to be 90% by mass or more in order to prevent precipitation and segregation. If the sum of the contents is less than 90% by mass, refinement of crystal grains or amorphization cannot be expected, workability is degraded, and the production cost is increased, which is not practical.

In the Mg—Li-based alloy of this embodiment, the sum of the content of Al and the content of Ge and Be is preferably 3% by mass or more and 7% by mass or less. Accordingly, in the Mg—Li-based alloy, the effect of increasing the strength of the alloy due to Al and the effect of increasing the strength of the alloy due to Ge and Be can be synergistically exhibited.

In the Mg—Li-based alloy of this embodiment, the content of Li relative to the sum of the content of Mg and the content of Li is preferably 0.5% by mass or more and 15% by mass or less. Accordingly, in the Mg—Li-based alloy, the weight of the alloy can be effectively reduced. If the content of Li is less than 0.5% by mass, the weight of the alloy cannot be reduced relative to that of Mg alloys, and thus such a content is not preferable in terms of reduction in weight. If the content of Li exceeds 15% by mass, the vibration-damping properties may be insufficient.

In the Mg—Li-based alloy of this embodiment, the sum of the content of Ge and Be, the content of Al, and the content of one or a plurality of metal elements selected from Si, P, Zn, and As is preferably 3% by mass or more and 10% by mass or less. Accordingly, refinement of crystal grains or amorphization occurs more easily. Consequently, the alloy has further improved corrosion resistance. When the Mg—Li-based alloy contains a plurality of metal elements selected from Si, P, Zn, and As, the sum of the total content of the plurality of selected metal elements, the content of Ge and Be, and the content of Al is 3% by mass or more and 10% by mass or less. For example, when the Mg—Li-based alloy contains Si and Zn, the sum of the content of Ge and Be, the content of Al, the content of Si, and the content of Zn is 3% by mass or more and 10% by mass or less.

In the Mg—Li-based alloy of this embodiment, the content of Ca is preferably 0.1% by mass or more and 2% by mass or less. Accordingly, in the Mg—Li-based alloy, corrosion resistance of the alloy is further improved.

The Mg—Li-based alloy of this embodiment may contain metal elements other than the metal elements listed above within a range that does not change the characteristics. These metal elements include unavoidable impurities that are unavoidably mixed during production. Examples of the unavoidable impurities include Fe, Ni, Cu, and Mn. Even when the Mg—Li alloy contains Fe, Ni, and Cu, the characteristics do not change as long as the contents of Fe, Ni, and Cu contained in the Mg—Li alloy are each less than 0.1% by mass. Even when the Mg—Li-based alloy of this embodiment contains Mn, the characteristics do not change as long as the content of Mn is less than 1% by mass.

A description has been made of the case where the Mg—Li-based alloy is used as the metal that forms the housing 620 of the lens barrel 601; however, the applications are not limited to this. The metal that forms the housing 621 of the camera body 602 may also be formed by using a Mg—Li-based alloy having the same configuration as the Mg—Li-based alloy used as the housing 620.

The method for producing the Mg—Li-based alloy of this embodiment is not particularly limited. Examples of the production method include casting, extrusion, and forging. An example of the method for adjusting the composition is a method including mixing and melting metal pieces or alloy pieces made of desired metal elements.

The Mg—Li-based alloy of this embodiment is preferably subjected to heat treatment (post-annealing) after solidification from the molten state. This is because metal elements such as Mg, Li, Al, and Ge contained in the Mg—Li-based alloy are diffused into the alloy at a temperature near the recrystallization temperature of the Mg—Li-based alloy to newly form a compound, and hardness can be thereby increased.

Electronic Apparatus

Figure 7:
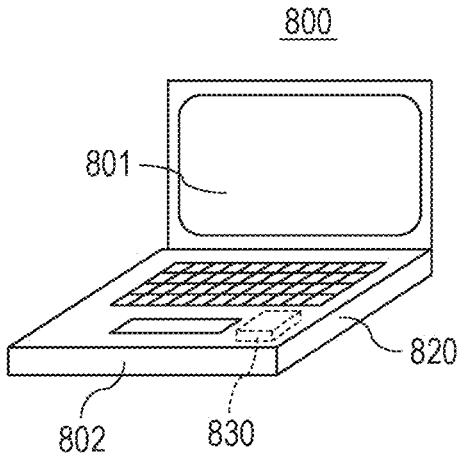
FIG. 7 is a schematic view illustrating an electronic apparatus according to an embodiment.

FIG. 7 illustrates the configuration of a personal computer, which is an example of a preferred embodiment of an electronic apparatus according the present invention. In FIG. 7, a personal computer 800 includes a display unit 801 and a main body 802. An electronic component 830 is disposed inside a housing 820 of the main body 802. The magnesium-lithium-based alloy according to the present invention can be used as the housing 820 of the main body 802. The housing 820 may be formed of only the magnesium-lithium-based alloy according to the present invention or formed of the magnesium-lithium-based alloy according to the present invention and a coating film disposed on the magnesium-lithium-based alloy. Since the magnesium-lithium-based alloy according to the present invention is lightweight and has good corrosion resistance, it is possible to provide a personal computer having a lighter weight and better corrosion resistance than existing personal computers.

The electronic apparatus according to the present invention has been described with the personal computer 800 taken as an example. However, the present invention is not limited to this. The electronic apparatus may be a smartphone or a tablet.

Moving Object

Figure 8:
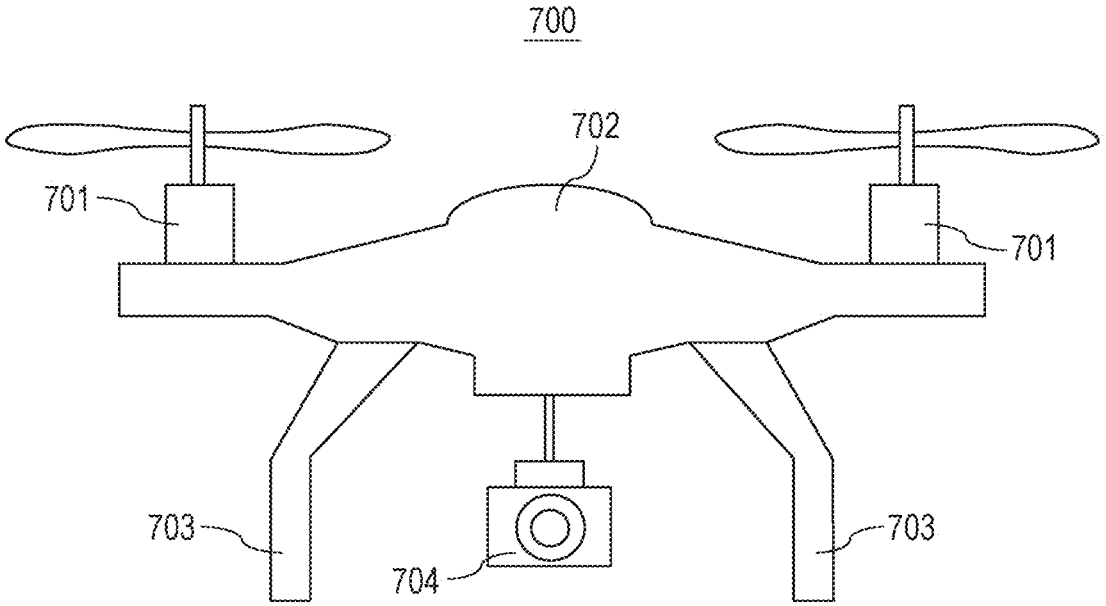
FIG. 8 is a schematic view illustrating a moving object according to an embodiment.

FIG. 8 is a view illustrating an embodiment of a drone, which is an example of a moving object according to the present invention. A drone 700 includes a plurality of driving units 701 and a main body 702 connected to the driving units 701. The driving units 701 each have, for example, a propeller. As illustrated in FIG. 8, the main body 702 may be configured so that leg portions 703 are connected thereto or a camera 704 is connected thereto. The magnesium-lithium-based alloy according to the present invention can be used as a housing 710 of the main body 702 and the leg portions 703. The housing 710 may be formed of only the magnesium-lithium-based alloy according to the present invention or formed of the magnesium-lithium-based alloy according to the present invention and a coating film disposed on the magnesium-lithium-based alloy. Since the magnesium-lithium-based alloy according to the present invention has good vibration-damping properties and corrosion resistance, it is possible to provide a drone having better vibration-damping properties and corrosion resistance than existing drones.

EXAMPLES

First, a Mg base metal was melted by heating to 700° C. to 800° C. in an argon atmosphere. Subsequently, metal pieces or alloy pieces of respective elements (such as Al and Ge) were added in necessary amounts so as to have the composition ratio shown in Table 1. The resulting molten metal was then cast into a mold and cooled to produce a Mg alloy ingot.

Next, the Mg alloy ingot was cut into small pieces. The small pieces and Li alloy pieces were mixed in a ceramic melting crucible and re-melted at 850° C. by high-frequency induction heating in an argon atmosphere, and the resulting molten metal was sufficiently subjected to electromagnetic stirring in the melting crucible. The Li concentration was changed by changing the amount of the Li alloy pieces added. Thus, alloys having the compositions shown in Table 1 were produced. Hereinafter, "% by mass" may be expressed as "%" by omitting the letters of "by mass".

TABLE 1

| | | Composition (unit: % by mass) | | | |
|---|---|---|---|---|---|
| | | Mg | Mg + Li | Li/(Mg + Li) | Ge |
| Example 1 | Mg-1.67% Li-1.6% Ca-4.8% Al-0.8% Ge-0.2% Zn-0.02% Mn | 90.9 | 92.6 | 1.8 | 0.8 |
| Example 2 | Mg-3.35% Li-1.2% Ca-4.6% Al-0.6% Ge-0.4% Zn-0.04% Mn | 89.8 | 93.2 | 3.6 | 0.6 |
| Example 3 | Mg-5.9% Li-1.2% Ca-4.4% Al-0.11% Be | 88.4 | 94.3 | 6.3 | |
| Example 4 | Mg-8.8% Li-0.9% Ca-3.9% Al-0.07% Be | 86.3 | 95.1 | 9.3 | |

TABLE 1-continued

| | | | | | |
|---|---|---|---|---|---|
| Example 5 | Mg-10.3% Li-1.4% Ca-3.6% Al-0.6% Ge-0.05% Be-0.3% Si | 83.8 | 94.1 | 11.0 | 0.6 |
| Example 6 | Mg-11% Li-1.0% Ca-3.4% Al-0.4% Ge-0.04% Be-0.2% Si | 84.0 | 95.0 | 11.6 | 0.4 |
| Example 7 | Mg-8.6% Li-1.2% Ca-5.7% Al-0.1% Ge-0.11% Mn-0.05% Si | 84.2 | 92.8 | 9.3 | 0.1 |
| Comparative Example 1 | Mg-0.28% Li-2% Ca-6% Al | 91.7 | 92.0 | 0.3 | |
| Comparative Example 2 | Mg-1.67% Li-1.6% Ca-5.6% Al-0.2% Zn-0.02% Mn | 90.9 | 92.6 | 1.8 | |
| Comparative Example 3 | Mg-3.35% Li-1.2% Ca-5.2% Al-0.4% Zn-0.04% Mn | 89.8 | 93.2 | 3.6 | |
| Comparative Example 4 | Mg-14.48% Li-0.3% Ca-3% Al-0.15% Mn | 82.1 | 96.6 | 15.0 | |
| Comparative Example 5 | Mg-9.5% Li-4.2% Al-1.0% Zn | 85.3 | 94.8 | 10.0 | |

| | Composition (unit: % by mass) | | | Ge + Be + Al + |
|---|---|---|---|---|
| | Be | Al + Ge + Be | Ca | Zn + Si |
| Example 1 | | 5.6 | 1.6 | 5.8 |
| Example 2 | | 5.2 | 1.2 | 5.6 |
| Example 3 | 0.11 | 4.5 | 1.2 | 4.6 |
| Example 4 | 0.07 | 4.0 | 0.9 | 4.0 |
| Example 5 | 0.05 | 4.3 | 1.4 | 4.6 |
| Example 6 | 0.04 | 3.8 | 1.0 | 4.0 |
| Example 7 | | 5.8 | 1.2 | 5.9 |
| Comparative Example 1 | | 6.0 | 2.0 | 6.0 |
| Comparative Example 2 | | 5.6 | 1.6 | 5.8 |
| Comparative Example 3 | | 5.2 | 1.2 | 5.6 |
| Comparative Example 4 | | 3.0 | 0.3 | 3.0 |
| Comparative Example 5 | | 4.2 | | 5.2 |

The alloy raw materials were each melted in a crucible made of ceramic or carbon. The molten alloys were each sprayed on a copper roll with an argon gas pressure to obtain ribbons having a thickness of about 0.2 mm and a width of 7 mm. The elemental components were determined by X-ray fluorescence analysis, and the correction of the concentrations was performed.

In an environmental test, the surfaces of the ribbons obtained above were untreated, and the ribbons were left to stand in a high-temperature high-humidity environment at a temperature of 70° C. and a humidity of 80 RH % for 1,000 hours. After the ribbon samples were left to stand, the change in the surface of each sample was examined with an optical microscope and a SEM-EDX (manufactured by ZEISS, trade name: FE-SEM). The hardness was measured with a Vickers hardness tester (manufactured by Mitutoyo Corporation, trade name: Micro Vickers hardness testing machine HM-200). Table 2 shows the evaluation results of the surface state after the environmental test and the results of the measurement of the hardness. In Table 2, a sample having a good surface state after the environmental test is denoted by "A", and a sample having a poor surface state is denoted by "B". In addition, the crystalline state was determined by the 2θ-θ measurement with an X-ray diffractometer (manufactured by Rigaku Corporation, trade name: Multipurpose X-ray diffractometer Ultima IV).

TABLE 2

| | | Evaluation result | |
|---|---|---|---|
| | | Environmental test | Hardness (Hv) |
| Example 1 | Mg-1.67% Li-1.6% Ca-4.8% Al-0.8% Ge-0.2% Zn-0.02% Mn | A | 81 |

TABLE 2-continued

| | | Evaluation result | |
|---|---|---|---|
| | | Environmental test | Hardness (Hv) |
| Example 2 | Mg-3.35% Li-1.2% Ca-4.6% Al-0.6% Ge-0.4% Zn-0.04% Mn | A | 83 |
| Example 3 | Mg-5.9% Li-1.2% Ca-4.4% Al-0.11% Be | A | 75 |
| Example 4 | Mg-8.8% Li-0.9% Ca-3.9% Al-0.07% Be | A | 76 |
| Example 5 | Mg-10.3% Li-1.4% Ca-3.6% Al-0.6% Ge-0.05% Be-0.3% Si | A | 79 |
| Example 6 | Mg-11% Li-1.0% Ca-3.4% Al-0.4% Ge-0.04% Be-0.2% Si | A | 76 |
| Example 7 | Mg-8.6% Li-1.2% Ca-5.7% Al-0.1% Ge-0.11% Mn-0.05% Si | A | 77 |
| Comparative Example 1 | Mg-0.28% Li-2% Ca-6% Al | B | 71 |
| Comparative Example 2 | Mg-1.67% Li-1.6% Ca-5.6% Al-0.2% Zn-0.02% Mn | B | 69 |
| Comparative Example 3 | Mg-3.35% Li-1.2% Ca-5.2% Al-0.4% Zn-0.04% Mn | B | 70 |
| Comparative Example 4 | Mg-14.48% Li-0.3% Ca-3% Al-0.15% Mn | B | 67 |
| Comparative Example 5 | Mg-9.5% Li-4.2% Al-1.0% Zn | B | 67 |

Examples 1, 2, and 7

As Example 1, a Mg—Li-based alloy of Mg-1.67% Li-1.6% Ca-4.8% Al-0.8% Ge-0.2% Zn-0.02% Mn was produced. As Example 2, a Mg—Li-based alloy of Mg-3.35% Li-1.2% Ca-4.6% Al-0.6% Ge-0.4% Zn-0.04% Mn was produced. As Example 7, a Mg—Li-based alloy of Mg-8.6% Li-1.2% Ca-5.7% Al-0.1% Ge-0.11% Mn-0.05% Si was produced.

In each of the Mg—Li-based alloys of Examples 1, 2, and 7, the sum of the content of Mg and the content of Li was 90% by mass or more. In each of the Mg—Li-based alloys of Examples 1, 2, and 7, Al, Ca, and Ge were contained.

Furthermore, in each of the Mg—Li-based alloys of Examples 1, 2, and 7, the sum of the content of Al and the content of Ge was in the range of 3% by mass or more and 7% by mass or less. Furthermore, in each of the Mg—Li-based alloys of Examples 1, 2, and 7, the content of Ca was in the range of 0.1% by mass or more and 1.6% by mass or less. In each of the Mg—Li-based alloys of Examples 1, 2, and 7, the content of Li relative to the sum of the content of Mg and the content of Li was in the range of 0.5% by mass or more and 15% by mass or less. In each of the Mg—Li-based alloys of Examples 1 and 2, Zn was contained as at least one metal element selected from Si, P, Zn, and As. In each of the Mg—Li-based alloys of Examples 1 and 2, the sum of the content of Ge, the content of Al, and the content of Zn was in the range of 3% by mass or more and 7% by mass or less.

Examples 3 and 4

As Example 3, a Mg—Li-based alloy of Mg-5.9% Li-1.2% Ca-4.4% Al-0.11% Be was produced. As Example 4, a Mg—Li-based alloy of Mg-8.8% Li-0.9% Ca-3.9% Al-0.07% Be was produced.

In each of the Mg—Li-based alloys of Examples 3 and 4, the sum of the content of Mg and the content of Li was 90% by mass or more. In each of the Mg—Li-based alloys of Examples 3 and 4, Al, Ca, and Be were contained.

Furthermore, in each of the Mg—Li-based alloys of Examples 3 and 4, the sum of the content of Al and the content of Be was in the range of 3% by mass or more and 10% by mass or less. Furthermore, in each of the Mg—Li-based alloys of Examples 3 and 4, the content of Ca was in the range of 0.1% by mass or more and 4% by mass or less. In each of the Mg—Li-based alloys of Examples 3 and 4, the content of Li relative to the sum of the content of Mg and the content of Li was in the range of 0.5% by mass or more and 15% by mass or less.

Examples 5 and 6

As Example 5, a Mg—Li-based alloy of Mg-10.3% Li-1.4% Ca-3.6% Al-0.6% Ge-0.05% Be-0.3% Si was produced. As Example 6, a Mg—Li-based alloy of Mg-11% Li-1.0% Ca-3.4% Al-0.4% Ge-0.04% Be-0.2% Si was produced.

In each of the Mg—Li-based alloys of Examples 5 and 6, the sum of the content of Mg and the content of Li was 90% by mass or more. In each of the Mg—Li-based alloys of Examples 5 and 6, Al, Ca, Ge, and Be were contained.

Furthermore, in each of the Mg—Li-based alloys of Examples 5 and 6, the sum of the content of Al, the content of Ge and Be was in the range of 3% by mass or more and 10% by mass or less. Furthermore, in each of the Mg—Li-based alloys of Examples 5 and 6, the content of Ca was in the range of 0.1% by mass or more and 4% by mass or less. In each of the Mg—Li-based alloys of Examples 5 and 6, the content of Li relative to the sum of the content of Mg and the content of Li was in the range of 0.5% by mass or more and 15% by mass or less. In each of the Mg—Li-based alloys of Examples 5 and 6, Si was contained as at least one metal element selected from Si, P, Zn, and As. In each of the Mg—Li-based alloys of Examples 5 and 6, the sum of the content of Ge and Be, the content of Al, and the content of Si was in the range of 3% by mass or more and 10% by mass or less.

Figure 3:
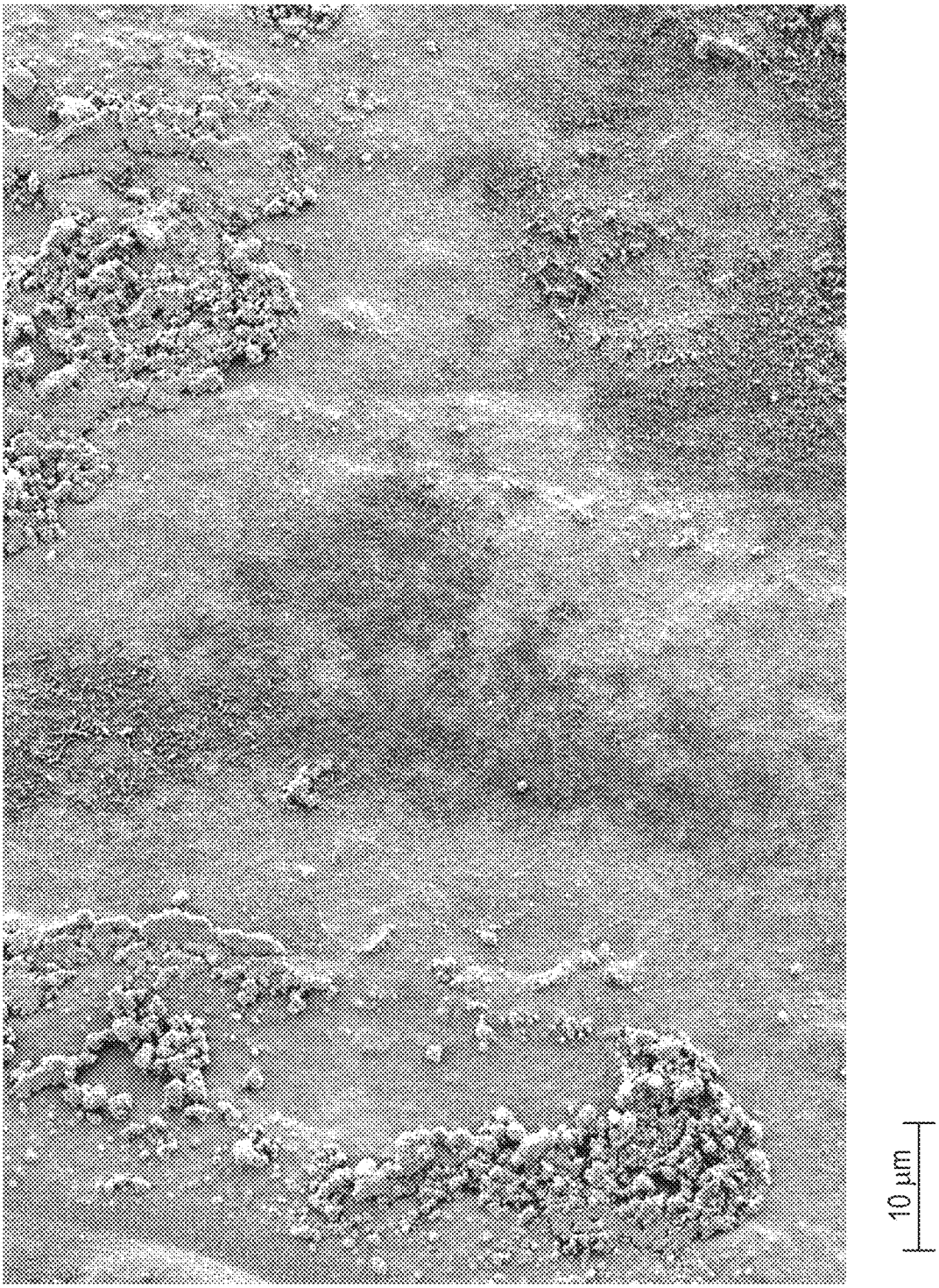
FIG. 3 is a SEM image of a surface of a Mg—Li-based alloy of Example 1.

The Mg—Li-based alloys of Examples 1 to 7 were subjected to the environmental test described above. The results showed that the metallic luster was maintained. After the environmental test, the Mg—Li-based alloy of Example 1 was observed with a SEM. FIG. 3 is a SEM image of a surface of the Mg—Li-based alloy of Example 1. As shown in FIG. 3, most of the surface was smooth.

Figure 4:
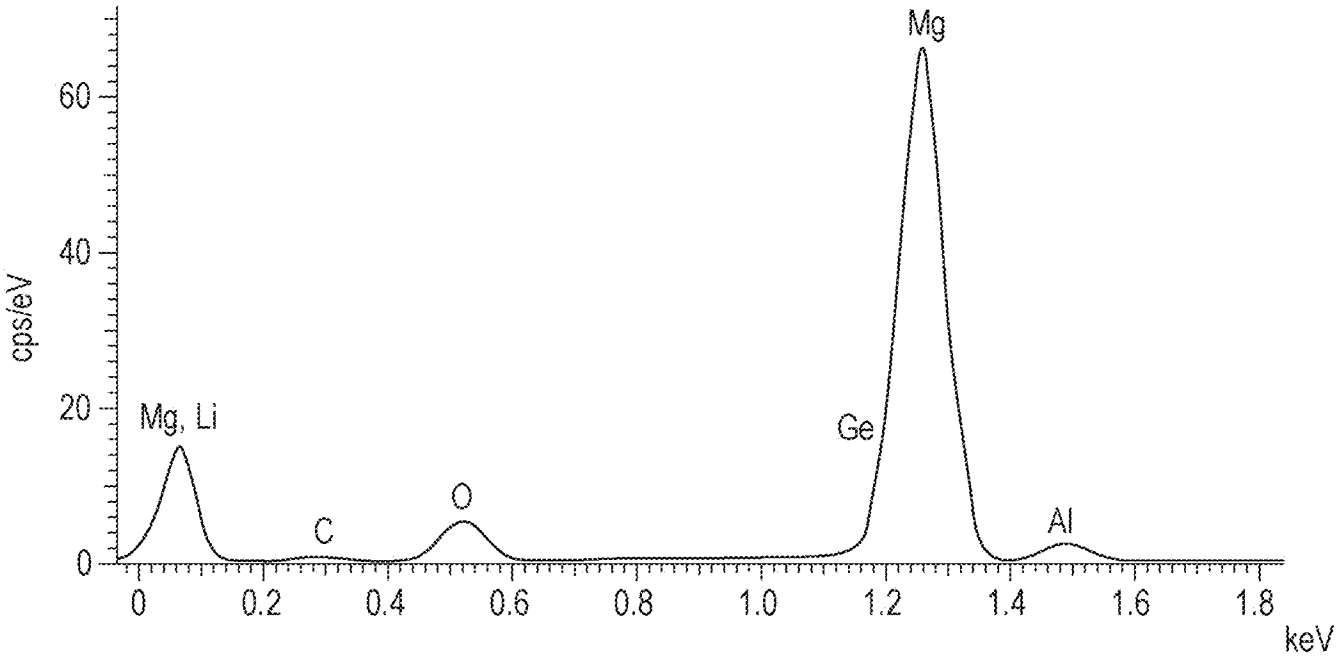
FIG. 4 is a graph showing the results of component analysis on a surface of a Mg—Li-based alloy of Example 1.

FIG. 4 is a graph showing the results of component analysis on the surface of the Mg—Li-based alloy of Example 1. A smooth portion on the surface of the Mg—Li-based alloy of Example 1 was observed by EDX. As shown in FIG. 4, Mg, Li, and O elements were substantially the same as those in the initial state, and oxidation, that is, corrosion on the surface was suppressed.

In particular, in the Mg—Li-based alloys of Examples 1, 2, and 5 to 7, in which the content of Ge element was less than 1% by mass, and the Mg—Li-based alloys of Examples 3 and 4, in which the content of Be element was 0.11% by mass or less, oxidation corrosion of the alloy surfaces were effectively suppressed. According to the results of XRD, the alloys of Examples 1 to 7 were polycrystalline, and a shift to the high-angle side due to compression was observed in the Mg matrix. The presence or absence of the peak shift was determined by a peak around $2\theta=63°$. This peak shift presumably indicates that constituent elements other than Mg substitute the matrix to form a solid solution. Furthermore, as shown in Table 2, with the addition of Ge element, the hardness was increased by about Hv 10 and reached to a maximum of Hv 80.

Next, with regard to Example 7, heat treatment was further performed. Specifically, the Mg—Li-based alloy which was a sample was heated on a hot plate for 30 minutes such that the temperature of the Mg—Li-based alloy became 250° C. The hardness of the Mg—Li alloy of Example 7 after heating was increased to Hv 94. It is considered that metal elements such as Mg, Li, Al and Ge were diffused into the alloy at a temperature near the recrystallization temperature of the Mg—Li-based alloy of Example 7 to newly form a compound, and the hardness was thereby increased.

Comparative Example 1

As Comparative Example 1, a Mg—Li-based alloy of Mg-0.28% Li-2% Ca-6% Al was produced. The Mg—Li-based alloy of Comparative Example 1 was subjected to the environmental test described above. According to the results, many portions of the surface were turned black.

After the environmental test, the Mg—Li-based alloy of Comparative Example 1 was observed with a SEM.

Figure 6:
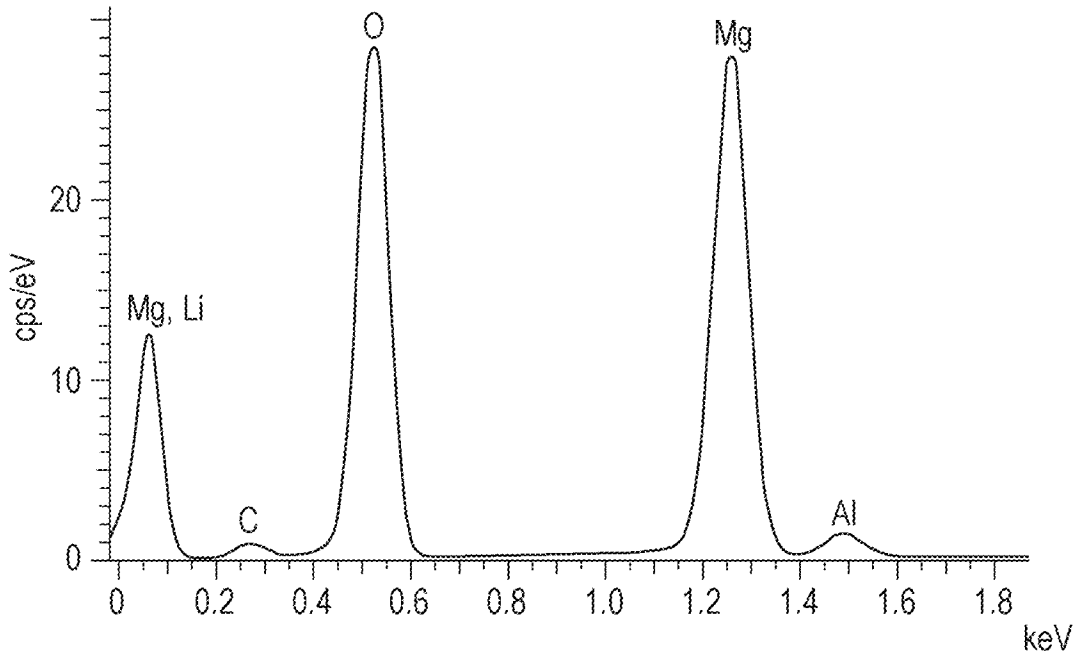
FIG. 6 is a graph showing the results of component analysis on a surface of a Mg—Li-based alloy of Comparative Example 1.

FIG. 6 is a graph showing the results of component analysis on a surface of the Mg—Li-based alloy of Comparative Example 1. The surface of the Mg—Li-based alloy of Comparative Example 1 was observed by EDX. As shown in FIG. 6, Li and O elements were significantly increased compared with those in the initial state, and this showed that oxidation proceeded on the surface. According to the results of XRD, the Mg—Li-based alloy of Comparative Example 1 was polycrystalline, and a compound phase was observed. On the other hand, the peak shift observed in Examples was not observed. Even in the alloy of Comparative Example 1, in which Al and Ca elements that are generally used to improve corrosion resistance of Mg alloys were added, corrosion could not be stopped in this environment.

Comparative Examples 2 and 3

Figure 5:
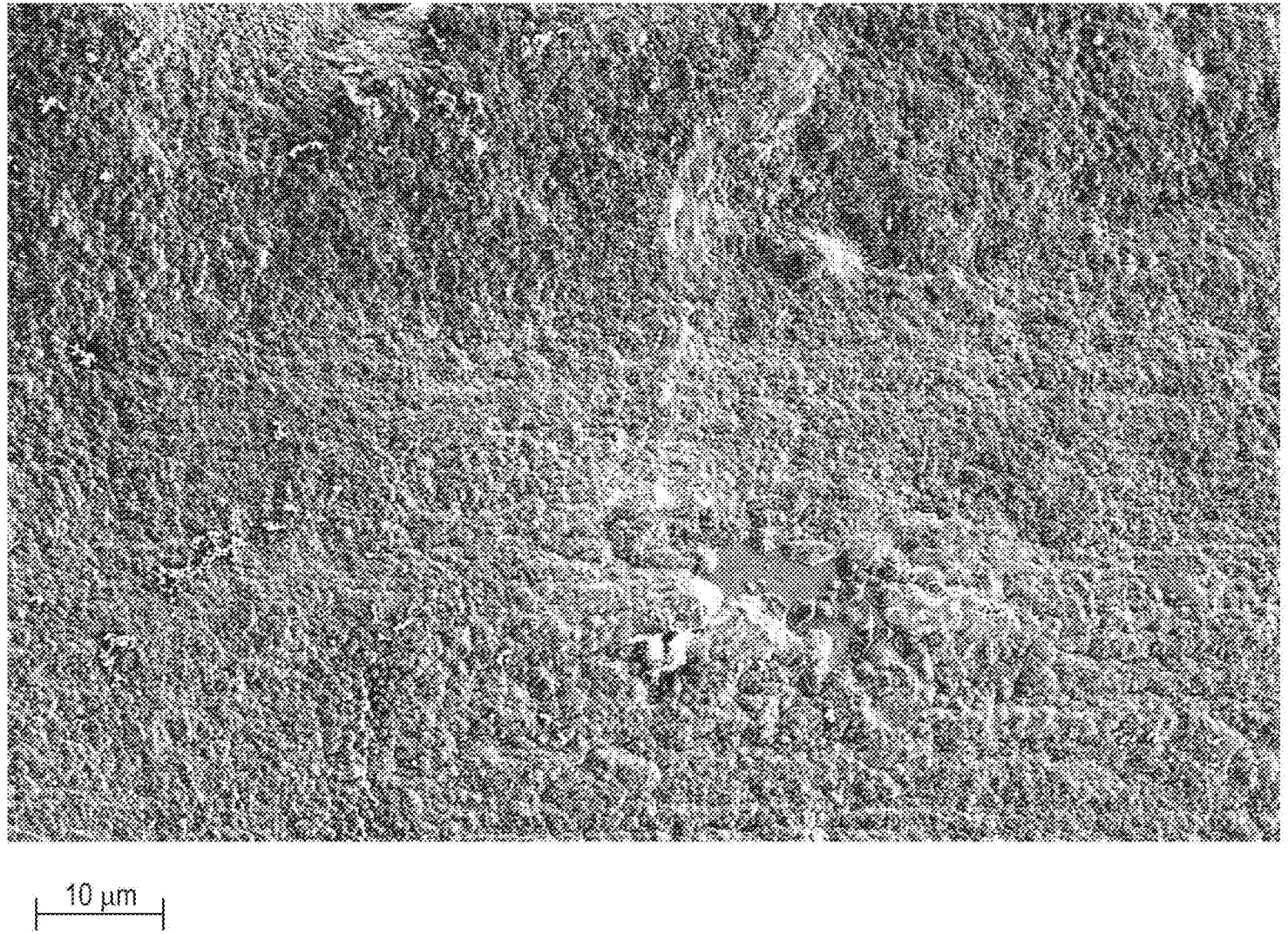
FIG. 5 is a SEM image of a surface of a Mg—Li-based alloy of Comparative Example 2.

As Comparative Example 2, a Mg—Li-based alloy of Mg-1.67% Li-1.6% Ca-5.6% Al-0.2% Zn-0.02% Mn was produced. As Comparative Example 3, a Mg—Li-based alloy of Mg-3.35% Li)-1.2% Ca-5.2% Al-0.4% Zn-0.04% Mn was produced. The Mg—Li-based alloys of Comparative Examples 2 and 3 were subjected to the environmental test described above. According to the results, many portions of the surfaces were turned black. FIG. 5 is a SEM image of a surface of the Mg—Li-based alloy of Comparative Example 2. As shown in FIG. 5, most of the surface was significantly roughened.

After the environmental test, the Mg—Li-based alloys of Comparative Examples 2 and 3 were each observed with a SEM. According to the results, most of the surface was significantly roughened as in Comparative Example 1. The surfaces of the Mg—Li-based alloys of Comparative Examples 2 and 3 were observed by EDX. Lithium (Li) and O elements were significantly increased compared with those in the initial state, and this showed that oxidation proceeded on the surfaces. Even in the alloys of Comparative Examples 2 and 3, in which Al, Zn, and Mn elements that are generally used to improve corrosion resistance of Mg alloys were added, corrosion could not be stopped in this environment.

Comparative Example 4

As Comparative Example 4, a Mg—Li-based alloy of Mg-14.48% Li-0.3% Ca-3% Al-0.15% Mn was produced. The Mg—Li-based alloy of Comparative Example 4 was subjected to the environmental test described above. According to the results, the entire surface was turned to white, and the surface was brittle and crumbled.

Comparative Example 5

As Comparative Example 5, a Mg—Li-based alloy of Mg-9.5% Li-4.2% Al-1.0% Zn was produced. The Mg—Li-based alloy of Comparative Example 5 was subjected to the environmental test described above. According to the results, the entire surface was turned to white, and the surface was brittle and crumbled as in Comparative Example 4.

Here, the Mg—Li-based alloy of Example 1 is one in which Al is partially replaced by Ge with respect to the Mg—Li-based alloy of Comparative Example 2. The Mg—Li-based alloy of Example 2 is one in which Al is partially replaced by Ge with respect to the Mg—Li-based alloy of Comparative Example 3. The Mg—Li-based alloys of Examples 3 and 4 are those in which Al is partially replaced by Be with respect to the Mg—Li-based alloy of Comparative Example 1. The Mg—Li-based alloys of Examples 5 to 7 are those in which Al is partially replaced by Ge or Ge, Be and Si with respect to the Mg—Li-based alloy of Comparative Example 4. The results of the environmental test showed that the alloys of Examples 1 to 7 exhibited improved corrosion resistance compared with the alloys of Comparative Examples 1 to 4 even when exposed to the high-temperature high-humidity environment for a long time.

After the environmental test, the Mg—Li-based alloys of Comparative Examples 4 and 5 were each observed with a SEM. According to the results, most of the surface was significantly roughened. The surfaces of the Mg—Li-based alloys of Comparative Examples 4 and 5 were observed by EDX. Lithium (Li) and O elements were significantly increased compared with those in the initial state, and this showed that oxidation proceeded on the surfaces. Significant corrosion was observed in the alloys in which a large amount of Li element was present in the form of a solid solution.

According to the present invention, corrosion of the alloy can be suppressed even when the alloy is exposed to a high-temperature high-humidity environment for a long time.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

The invention claimed is:

1. A magnesium-lithium-based alloy comprising Mg, Li, Al, and Ni, a content of the Ni being more than 0% by mass and less than 0.1% by mass, wherein a sum of a content of the Mg and a content of the Li is 90% by mass or more, wherein the alloy further comprises:

a) Ge, or b) Be, or c) Ge and Be, wherein in the case of a) where the alloy comprises the Ge, a content of the Ge is 0.1% by mass or more and less than 1.0% by mass, wherein in the case of b) where the alloy comprises the Be, a content of the Be is 0.04% by mass or more and less than 3% by mass, and wherein in the case of c) where the alloy comprises the Ge and the Be, a sum of a content of the Al and a content of the Ge and the Be is 3% by mass or more and 7% by mass or less.

2. The magnesium-lithium-based alloy according to claim 1, wherein the content of the Li relative to the sum of the content of the Mg and the content of the Li is 0.5% by mass or more and 15% by mass or less.

3. The magnesium-lithium-based alloy according to claim 2, wherein the content of the Li relative to the sum of the content of the Mg and the content of the Li is 0.5% by mass or more and 11.6% by mass or less.

4. The magnesium-lithium-based alloy according to claim 1, further comprising Ca, wherein a content of the Ca is 0.1% by mass or more and 2% by mass or less.

5. The magnesium-lithium-based alloy according to claim 1, wherein a sum of a content of the Ge and Be, a content of the Al, and a content of the Si, P, Zn, and As is 3% by mass or more and 10% by mass or less.

6. The magnesium-lithium-based alloy according to claim 5, wherein a sum of contents of the Ge, Be, Si, P, Zn, and As is smaller than a content of the Al.

7. The magnesium-lithium-based alloy according to claim 1, wherein a sum of a content of the Al and a content of the Ge and Be is 3% by mass or more and 7% by mass or less.

8. An optical apparatus comprising a housing and an optical system including a plurality of lenses disposed in the housing, wherein the housing includes the magnesium-lithium-based alloy according to claim 1.

9. An imaging apparatus comprising a housing and an imaging device disposed in the housing, wherein the housing includes the magnesium-lithium-based alloy according to claim 1.

10. The imaging apparatus according to claim 9, wherein the imaging apparatus is a camera.

11. An electronic apparatus comprising a housing and an electronic component disposed in the housing, wherein the housing includes the magnesium-lithium-based alloy according to claim 1.

12. A moving object comprising a main body and a driving unit, wherein a housing of the main body includes the magnesium-lithium- based alloy according to claim 1.

13. The magnesium-lithium-based alloy according to claim 1, wherein a sum of contents of the Si, P, Zn, and As is smaller than a content of the Al.

* * * * *